US011574577B2

(12) United States Patent
Zhai

(10) Patent No.: US 11,574,577 B2
(45) Date of Patent: Feb. 7, 2023

(54) METHOD AND DEVICE FOR CALIBRATING COLOR GAMUT OF DISPLAY SCREEN, AND ELECTRONIC DEVICE

(71) Applicant: BEIJING XIAOMI MOBILE SOFTWARE CO., LTD., Beijing (CN)

(72) Inventor: Dong Zhai, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 17/099,695

(22) Filed: Nov. 16, 2020

(65) Prior Publication Data

US 2021/0375180 A1 Dec. 2, 2021

(30) Foreign Application Priority Data

May 29, 2020 (CN) ..... 202010479618.6

(51) Int. Cl.
*G09G 3/20* (2006.01)
*G09G 5/02* (2006.01)
*G09G 3/3208* (2016.01)

(52) U.S. Cl.
CPC ..... *G09G 3/2003* (2013.01); *G09G 3/3208* (2013.01); *G09G 5/026* (2013.01); *G09G 2340/06* (2013.01)

(58) Field of Classification Search
CPC .. G09G 3/20; G09G 3/32; G09G 3/34; G09G 3/36; G09G 3/2003; G09G 3/3208; G09G 3/3225; G09G 3/3275; G09G 3/3266; G09G 5/00; G09G 5/02; G09G 5/04; G09G 5/06; G09G 5/10; G09G 5/026; G09G 2340/06; H04N 9/31; H04N 9/64; H04N 9/65;
(Continued)

(56) References Cited

U.S. PATENT DOCUMENTS

2012/0194539 A1* 8/2012 Zhang ..... G09G 3/2003 382/167
2013/0249955 A1* 9/2013 Kim ..... G09G 3/3233 345/77
(Continued)

FOREIGN PATENT DOCUMENTS

CN 101339736 A 1/2009
CN 105161057 A 12/2015
(Continued)

OTHER PUBLICATIONS

Supplementary European Search Report in the European application No. 20208599.9, dated May 18, 2021.
(Continued)

*Primary Examiner* — Chanh D Nguyen
*Assistant Examiner* — Nguyen H Truong
(74) *Attorney, Agent, or Firm* — Syncoda LLC; Feng Ma

(57) ABSTRACT

A method for calibrating a color gamut of a display screen includes: acquiring a brightness level of the display screen, and original red green blue (RGB) values of a color to be displayed by a pixel in the display screen; determining, according to the brightness level of the display screen and the original RGB values, corrected color coordinates; and determining a calibrated RGB values according to the corrected color coordinates, and driving, with the calibrated RGB values, light emission of the pixel in the display screen.

17 Claims, 11 Drawing Sheets

(58) Field of Classification Search
CPC .. H04N 9/67; H04N 9/68; H04N 9/69; H04N 9/77; H04N 1/60; G06T 5/00; G06T 11/00; G06T 3/20; G06T 3/40; G06T 7/40; G06T 7/90; G06K 9/00
See application file for complete search history.

(56) References Cited

U.S. PATENT DOCUMENTS

| | | | | |
|---|---|---|---|---|
| 2014/0267785 | A1 | 9/2014 | Chen et al. | |
| 2014/0333681 | A1 | 11/2014 | Oh | |
| 2016/0293082 | A1 | 10/2016 | Zhang et al. | |
| 2016/0329027 | A1* | 11/2016 | Huang | H04N 9/73 |
| 2021/0006686 | A1* | 1/2021 | Luo | H04N 9/67 |
| 2021/0398471 | A1* | 12/2021 | Kidoguchi | G09G 5/02 |
| 2022/0057267 | A1* | 2/2022 | Sin | G01J 1/4204 |

FOREIGN PATENT DOCUMENTS

| | | | |
|---|---|---|---|
| CN | 108182914 | A | 6/2018 |
| CN | 108257572 | A | 7/2018 |
| CN | 110197642 | A | 9/2019 |
| JP | 2000315070 | A | 11/2000 |
| WO | 2020238960 | A1 | 12/2020 |

OTHER PUBLICATIONS

First Office Action of the Chinese Patent Application No. 202010479618.6, dated May 7, 2022.

* cited by examiner

METHOD AND DEVICE FOR CALIBRATING COLOR GAMUT OF DISPLAY SCREEN, AND ELECTRONIC DEVICE

CROSS-REFERENCE TO RELATED APPLICATION

This application claims priority to Chinese Patent Application No. 202010479618.6 filed on May 29, 2020, the disclosure of which is hereby incorporated by reference in its entirely.

BACKGROUND

With the development of display technologies, users are having higher and higher requirements for the display quality of a display screen. An organic light-emitting diode (OLED) display screen has a wider color gamut and a higher display contrast.

SUMMARY

The present disclosure relates generally to the technical field of color gamut calibration, and more specifically to a method and device for calibrating a color gamut of a display screen, and an electronic device.

Various embodiments of the disclosure provide a method and device for calibrating a color gamut of a display screen and an electronic device, to implement color gamut calibration for an OLED display screen.

According to a first aspect, provided in embodiments of the disclosure is a method for calibrating a color gamut of a display screen, including: acquiring a brightness level of the display screen, and original red green blue (RGB) values of a color to be displayed by a pixel in the display screen; determining, according to the brightness level of the display screen and the original RGB values, corrected color coordinates; and determining a calibrated RGB values according to the corrected color coordinates, and driving, with the calibrated RGB values, light emission of the pixel in the display screen.

In some embodiments, the determining, according to the brightness level of the display screen and the original RGB values, the corrected color coordinates includes: determining, according to the brightness level of the display screen and the original RGB values, a set of brightness compensation values; acquiring, according to the original RGB values, reference color coordinates corresponding to the RGB values; and determining, according to the set of brightness compensation values and the reference color coordinates, the corrected color coordinates.

In some embodiments, the determining, according to the brightness level of the display screen and the original RGB values, the set of brightness compensation values includes: determining, based on a preset mapping relationship, a brightness compensation value corresponding to each dimension of a color coordinate system according to the brightness level of the display screen and the original RGB values.

In some embodiments, the color coordinate system includes an x axis, a y axis, and a z axis, and determining, according to the set of brightness compensation values and the reference color coordinates, the corrected color coordinates includes: determining an x-axis coordinate of the corrected color coordinates, according to a brightness compensation value corresponding to the x axis and an x-axis coordinate of the reference color coordinates; determining a y-axis coordinate of the corrected color coordinates, according to a brightness compensation value corresponding to the y axis and a y-axis coordinate of the reference color coordinates; and determining a z-axis coordinate of the corrected color coordinates, according to a brightness compensation value corresponding to the z axis and a z-axis coordinate of the reference color coordinates.

In some embodiments, the method further includes: acquiring, under each of different brightness levels of the display screen, respective actual color coordinates of a color of light emitted by the pixel driven with set RGB values; selecting the reference color coordinates from all the actual color coordinates obtained under the different brightness levels of the display screen; when light emission of the pixel is driven with the set RGB values, acquiring a color coordinate difference according to the reference color coordinates and actual color coordinates corresponding to each of the different brightness levels of the display screen; and acquiring, according to the color coordinate difference and the corresponding brightness level of the display screen, a mapping relationship from a corresponding set of brightness compensation values to brightness levels of the display screen.

In some embodiments, the determining the calibrated RGB values according to the corrected color coordinates includes: determining the calibrated color coordinates according to the corrected color coordinates; and determining the calibrated RGB values according to the calibrated color coordinates.

In some embodiments, the determining the calibrated color coordinates according to the corrected color coordinates includes: converting, according to a rule of conversion from a source color gamut of the display screen to a target color gamut of the display screen, the corrected color coordinates into the calibrated color coordinates.

According to a second aspect, provided in embodiments of the disclosure is a device for calibrating a color gamut of a display screen, including: a first acquisition portion, configured to acquire a brightness level of the display screen, and original red green blue (RGB) values of a color to be displayed by a pixel in the display screen; a first determination portion, configured to determine, according to the brightness level of the display screen and the original RGB values, corrected color coordinates; and a second determination portion, configured to determine a calibrated RGB values according to the corrected color coordinates, and driving, with the calibrated RGB values, light emission of the pixel in the display screen.

In some embodiments, the first determination portion includes: a first determination unit, configured to determine, according to the brightness level of the display screen and the original RGB values, a set of brightness compensation values; a first acquisition unit, configured to acquire, according to the original RGB values, reference color coordinates corresponding to the RGB values; and a second determination unit, configured to determine, according to the set of brightness compensation values and the reference color coordinates, the corrected color coordinates.

In some embodiments, the first determination unit is specifically configured to: determine, based on a preset mapping relationship, a brightness compensation value corresponding to each dimension of a color coordinate system according to the brightness level of the display screen and the original RGB values.

In some embodiments, the color coordinate system includes an x axis, a y axis, and a z axis, and the second determination unit includes: a first determination subunit, configured to determine an x-axis coordinate of the corrected color coordinates, according to a brightness compensation value corresponding to the x axis and an x-axis coordinate of the reference color coordinates; a second determination subunit, configured to determine a y-axis coordinate of the corrected color coordinates, according to a brightness compensation value corresponding to the y axis and a y-axis coordinate of the reference color coordinates; and a third determination subunit, configured to determine a z-axis coordinate of the corrected color coordinates, according to a brightness compensation value corresponding to the z axis and a z-axis coordinate of the reference color coordinates.

In some embodiments, the device further includes: a second acquisition portion, configured to acquire, under each of different brightness levels of the display screen, respective actual color coordinates of a color of light emitted by the pixel driven with a set RGB values; a third determination portion, configured to select the reference color coordinates from all the actual color coordinates obtained under the different brightness levels of the display screen; a third acquisition portion, configured to: when light emission of the pixel is driven with the set RGB values, acquire a color coordinate difference according to the reference color coordinates and actual color coordinates corresponding to each of the different brightness levels of the display screen; and a fourth acquisition portion, configured to acquire, according to the color coordinate difference and the corresponding brightness level of the display screen, a mapping relationship from a corresponding set of brightness compensation values to brightness levels of the display screen.

In some embodiments, the second determination portion includes: a third determination unit, configured to determine the calibrated color coordinates according to the corrected color coordinates; and a fourth determination unit, configured to determine the calibrated RGB values according to the calibrated color coordinates.

In some embodiments, the third determination unit is specifically configured to: convert, according to a rule of conversion from a source color gamut of the display screen to a target color gamut of the display screen, the corrected color coordinates into the calibrated color coordinates.

According to a third aspect, provided in embodiments of the disclosure is an electronic device, including: a display screen, a memory having executable instructions stored thereon, and a processor configured to execute the executable instruction stored in the memory to implement the method for calibrating a color gamut of a display screen according to the first aspect above.

According to a fourth aspect, provided in embodiments of the disclosure is a readable storage medium having executable instructions stored thereon, wherein the executable instructions, when executed by a processor, cause the processor to implement the method for calibrating a color gamut of a display screen according to the first aspect above.

It is to be understood that the above general descriptions and detailed descriptions below are only exemplary and explanatory and not intended to limit the present disclosure.

BRIEF DESCRIPTION OF THE DRAWINGS

The accompanying drawings referred to in the specification are a part of this disclosure, and provide illustrative embodiments consistent with the disclosure and, together with the detailed description, serve to illustrate some embodiments of the disclosure.

DETAILED DESCRIPTION

Figure 1:
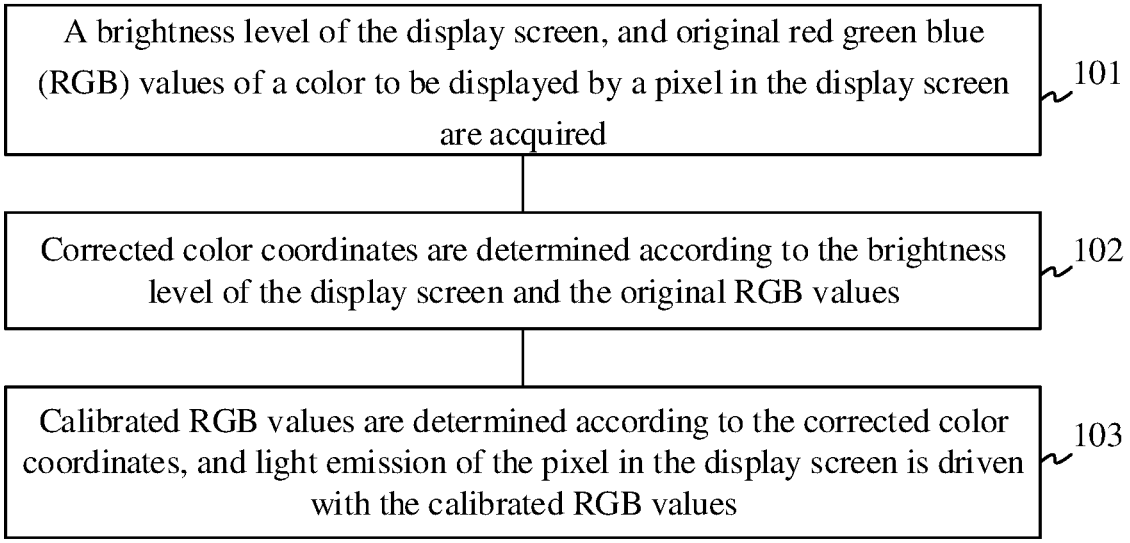
FIG. 1 illustrates a flowchart of a method for calibrating a color gamut of a display screen according to some embodiments of the present disclosure.

Exemplary embodiments (examples of which are illustrated in the accompanying drawings) are elaborated below. The following description refers to the accompanying drawings, in which identical or similar elements in two drawings are denoted by identical reference numerals unless indicated otherwise. The exemplary implementation modes may take on multiple forms, and should not be taken as being limited to examples illustrated herein. Instead, by providing such implementation modes, embodiments herein may become more comprehensive and complete, and comprehensive concept of the exemplary implementation modes may be delivered to those skilled in the art. Implementations set forth in the following exemplary embodiments do not represent all implementations in accordance with the subject disclosure. Rather, they are merely examples of the apparatus and method in accordance with certain aspects herein as recited in the accompanying claims.

Terms used in the disclosure are only used for the purpose of describing specific embodiments and not intended to limit the disclosure. Unless otherwise defined, the technical terms or scientific terms used in the disclosure should be understood normally by those of ordinary skill in the art of the disclosure. Terms like "a/an" or "one" used in the specification and claims of the disclosure do not represent a number limitation but only represents existence of at least one. Unless otherwise specified, terms like "comprise/include" or "contain" refer to that an element or object appearing before "comprise include" or "contain" covers an element or object and equivalent thereof listed after "comprise/include" or "contain" and does not exclude other elements or objects. Terms like "connect" or "interconnect" are not limited to physical or mechanical connection, and may include electrical connection, either direct or indirect. "A/an", "this" and "the" in a singular form in the specification and claims of the disclosure are also intended to include a plural form, unless other meanings are clearly denoted throughout the disclosure. It is also to be understood that term "and/or" used in the disclosure refers to and includes any or all possible combinations of multiple associated items that are listed.

A color gamut of a display screen is a set of all colors that can be displayed by the display screen. A standard color gamut of an electronic device is a Standard RGB (sRGB) color gamut and a Display-P3 color gamut, both of which are smaller than a source color gamut of an organic light-emitting diode (OLED) screen. Therefore, a color gamut of an OLED needs to be calibrated by means of color gamut mapping, to convert the source color gamut of the OLED display screen into the standard color gamut of the electronic device. That is, in order to avoid distortion caused by excessively sharp colors of an OLED display screen, the color gamut of the display screen needs to be calibrated.

However, through a method for calibrating a color gamut of an OLED display screen provided in the related art, color gamut calibration may be implemented under only one brightness level of the display screen. A color gamut calibration deviation may be produced with changing of the brightness of the display screen, resulting in a deviation of a hue of a color displayed by the display screen and affecting a display effect.

Based on the abovementioned situation, a method and device for calibrating a color gamut of a display screen, and an electronic device are provided in embodiments of the disclosure, to ensure the effect of color gamut calibration under different brightness conditions of the display screen.

FIG. 1 illustrates a method for calibrating a color gamut of a display screen according to some embodiments of the present disclosure. As illustrated in FIG. 1, the method for calibrating a color gamut for the display screen includes the following blocks 101 to 103.

In block 101, a brightness level of the display screen, and original red green blue (RGB) values of a color to be displayed by a pixel in the display screen are acquired.

The brightness level (dBv) of the display screen is used for representing brightness of the display screen. The original RGB values refers to tristimulus values of the color to be displayed by the pixel, i.e., a Red (R) value, a Green (G) value and a Blue (B) value. The original RGB values are related to an image to be displayed on the display screen. For example, if the image to be displayed is a pure red image, original RGB values of any pixel in the display screen is (255, 0, 0). In Block 101, the original RGB values of each pixel in the display screen may be acquired according to the image to be displayed on the display screen.

Exemplarily, the brightness level ndbv (n is a positive integer) of the display screen and the original values (R0, G0, B0) are acquired in block 101.

In block 102, a corrected color coordinate is determined according to the brightness level of the display screen and the original RGB values.

A color coordinate is an absolute coordinate representing a color. During calibration of a color gamut, the accuracy of the color gamut calibration can be ensured by converting an RGB values into color coordinates. Moreover, the brightness level of the display screen is taken as a reference for determining the corrected color coordinates in block 102, so that the influence of different brightness levels of the display screen on a hue of the color of light emitted by the pixel may be avoided.

Figure 2:
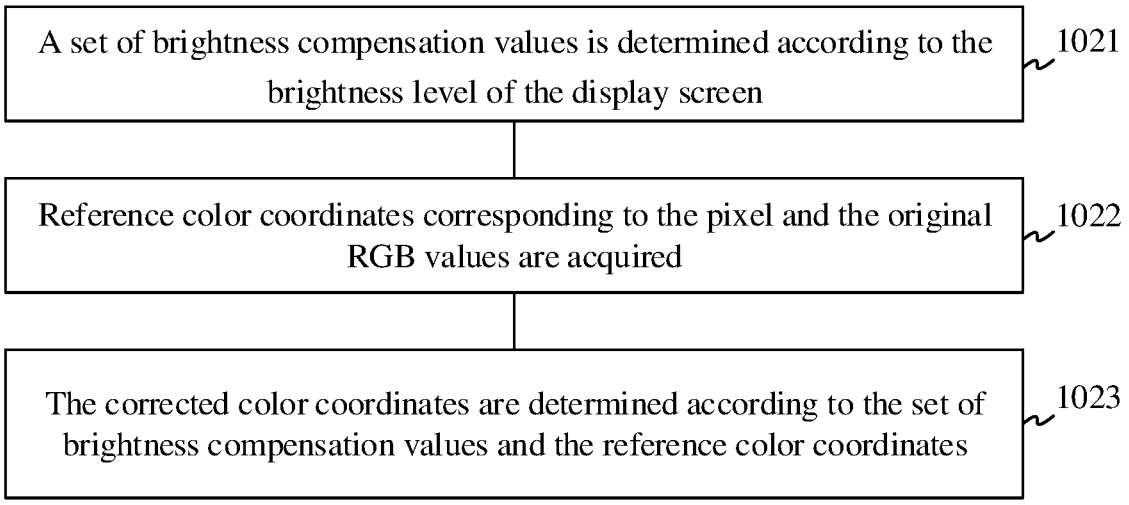
FIG. 2 illustrates a flowchart of a method for calibrating a color gamut of a display screen according to some embodiments of the present disclosure.

FIG. 2 illustrates a flowchart of a method for calibrating a color gamut of a display screen according to some embodiments of the present disclosure. In some embodiments, as illustrated in FIG. 2, block 102 specifically includes the following blocks 1021 to 1023.

In block 1021, a set of brightness compensation values is determined according to the brightness level of the display screen and the original RGB values.

A brightness compensation value is related to the brightness level of the display screen and represents the influence, on a color displayed by the display screen, of the brightness of the display screen. Moreover, the brightness compensation values are used for compensating for the color coordinates in different dimensions when the original RGB values are converted into the color coordinates.

The set of brightness compensation values include at least two brightness compensation values, each brightness compensation value corresponding to a dimension of a color coordinate system. For example, the color coordinates include coordinates in an x axis, a y axis and a z axis coordinate respectively, and the set of brightness compensation values includes a brightness compensation value corresponding to the x axis, a brightness compensation value corresponding to the y axis and a brightness compensation value corresponding to the z axis.

In this way, colors of light emitted by the pixel under different brightness levels of the display screen are always colors corresponding to reference color coordinates. That is, hues of the colors of light emitted by the pixel under different brightness levels are unified under compensation effect of the brightness compensation values. Furthermore, the accuracy of color gamut calibration under different brightness levels of the display screen is ensured, and a display effect of the display screen is optimized.

Exemplarily, block 1021 specifically includes that: a brightness compensation value corresponding to each dimension of a color coordinate system is determined according to a preset mapping relationship and the brightness level of the display screen. For example, if the color coordinate system includes an x axis, a y axis and a z axis, block 1021 includes that: a brightness compensation value $f_x(n)$ corresponding to the x axis, a brightness compensation value $f_y(n)$ corresponding to the y axis and a brightness compensation value $f_z(n)$ corresponding to the z axis are determined according to the preset mapping relationship and the brightness level of the display screen. n is the brightness level of the display screen acquired in block 101.

The preset mapping relationship is acquired in advance according to experimental tests. The particular process of acquiring the preset mapping relationship will be introduced below in detail.

In block 1022, reference color coordinates corresponding to the pixel and the original RGB values are acquired.

The reference color coordinates acquired in block 1022 are color coordinates of the color of light emitted when light emission of the pixel is driven with the original RGB values under a set brightness level condition of the display screen. Moreover, each set of RGB values corresponds to a respective set of reference color coordinates. In acquiring the preset mapping relationship, the reference color coordinates corresponding to the RGB values are determined. Accordingly, in block 1022, the reference color coordinates are acquired according to a pre-stored corresponding relationship of RGB values with respective sets of reference color coordinates and according to the present original RGB values.

The reference color coordinates serve as a basis for acquiring the corrected color coordinates in block 102, and compensation is made with the brightness compensation values acquired in block 1021 based on the reference color coordinates. Exemplarily, reference color coordinates (X0, Y0, Z0) corresponding to the original RGB values (R0, G0, B0) is acquired in block 1022.

In block 1023, the corrected color coordinates are determined according to the set of brightness compensation values and the reference color coordinates. For example, the color coordinates include an x-axis coordinate, a y-axis coordinate and a z-axis coordinate. Block 1023 specifically includes that:

an x-axis coordinate of the corrected color coordinates is determined according to the brightness compensation value corresponding to the x axis and an x-axis coordinate of the reference color coordinates, the x-axis coordinate of the corrected color coordinates being a sum ($X0+f_x(n)$) of the brightness compensation value corresponding to the x axis and the x-axis coordinate of the reference color coordinates;

a y-axis coordinate of the corrected color coordinates is determined according to the brightness compensation value corresponding to the y axis and a y-axis coordinate of the reference color coordinates, the y-axis coordinate of the corrected color coordinates being a sum ($Y0+f_y(n)$) of the brightness compensation value corresponding to the y axis and the y-axis coordinate of the reference color coordinates; and a z-axis coordinate of the corrected color coordinates is determined according to a brightness compensation value corresponding to the z axis and a z-axis coordinate of the reference color coordinates, the z-axis coordinate of the corrected color coordinates being a sum ($Z0+f_z(n)$) of the brightness compensation value corresponding to the z axis and the z-axis coordinate of the reference color coordinates.

In such case, the corrected color coordinates acquired in block 1023 are ($X0+f_x(n)$, $Y0+f_y(n)$, $Z0+f_z(n)$).

In the method for calibrating a color gamut provided in some embodiments of the disclosure, the colors of light emitted by the pixel under different brightness levels of the display screen are unified through block 102. In this way, the pixel displays a color corresponding to corrected color coordinates under different brightness levels of the display screen. Moreover, the brightness of the display screen only influences luminosity of light emitted by the pixel and does not influence the color of light emitted by the pixel. In this way, the stability of color gamut calibration under different brightness conditions of the display screen is optimized.

Further referring to FIG. 1, block 103 is executed after block 102, specifically as follows.

In block 103, a calibrated RGB values is determined according to the corrected color coordinates, and light emission of the pixel of the display screen is driven with the calibrated RGB values.

Figure 3:
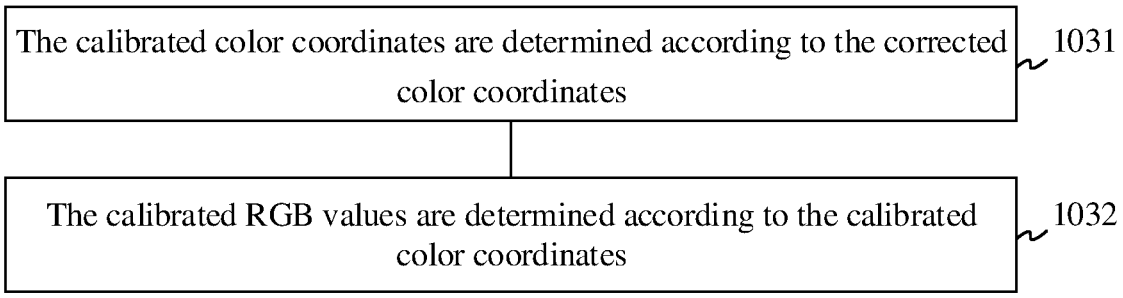
FIG. 3 illustrates a flowchart of a method for calibrating a color gamut of a display screen according to some embodiments of the present disclosure.

FIG. 3 illustrates a flowchart of a method for calibrating a color gamut of a display screen according to some embodiments of the present disclosure. In some embodiments, as illustrated in FIG. 3, the operation that the calibrated RGB values is determined according to the corrected color coordinates in block 103 specifically includes the following blocks 1031 to 1032.

In block 1031, the calibrated color coordinates are determined according to the corrected color coordinates.

The corrected color coordinates are still in a source color gamut of the OLED display screen, and the calibrated color coordinates are in a target color gamut (for example, an RGB color gamut or a Display-P3 color gamut) of the OLED display screen. Exemplarily, block 1031 includes that: the corrected color coordinates are converted into the calibrated color coordinates according to a rule of conversion from a source color gamut of the display screen to a target color gamut of the display screen. In some embodiments, the source color gamut of the display screen is converted into the target color gamut by operations such as matrix clip and matrix scaling.

Exemplarily, the corrected color coordinates ($X0+f_x(n)$, $Y0+f_y(n)$, $Z0+f_z(n)$) are converted to calibrated color coordinates (X1, Y1, Z1) in block 1031.

In block 1032, the calibrated RGB values are determined according to the calibrated color coordinates.

The calibrated color coordinates are converted to an RGB values according to an existing rule of conversion from color coordinates to an RGB values, so as to drive displaying of the pixel according to the calibrated RGB values in block 103. Exemplarily, the calibrated color coordinates (X1, Y1, Z1) are converted to the calibrated RGB values (R1, G1, B1) in block 1032.

According to the method for calibrating a color gamut provided in some embodiments of the disclosure, the brightness level of the display screen is taken as a reference for determining the calibrated RGB values. Specifically, the corrected color coordinates are determined according to the brightness level of the display screen, and the calibrated RGB values is further determined according to the corrected color coordinates. By driving light emission of the pixel of the display screen with the calibrated RGB values, the colors of light emitted by the pixel under different brightness levels of the display screen are unified. In such a manner, the hues of the colors of light emitted by the pixel under different brightness levels of the display screen always correspond to the corrected color coordinates. Accordingly, the brightness of the display screen only influences the luminosity of the color of light emitted by the pixel and does not influence the hue of the color of light emitted by the pixel. Furthermore, accurate calibration of a color gamut may be implemented by the method under different brightness conditions of the display screen.

Figure 4:
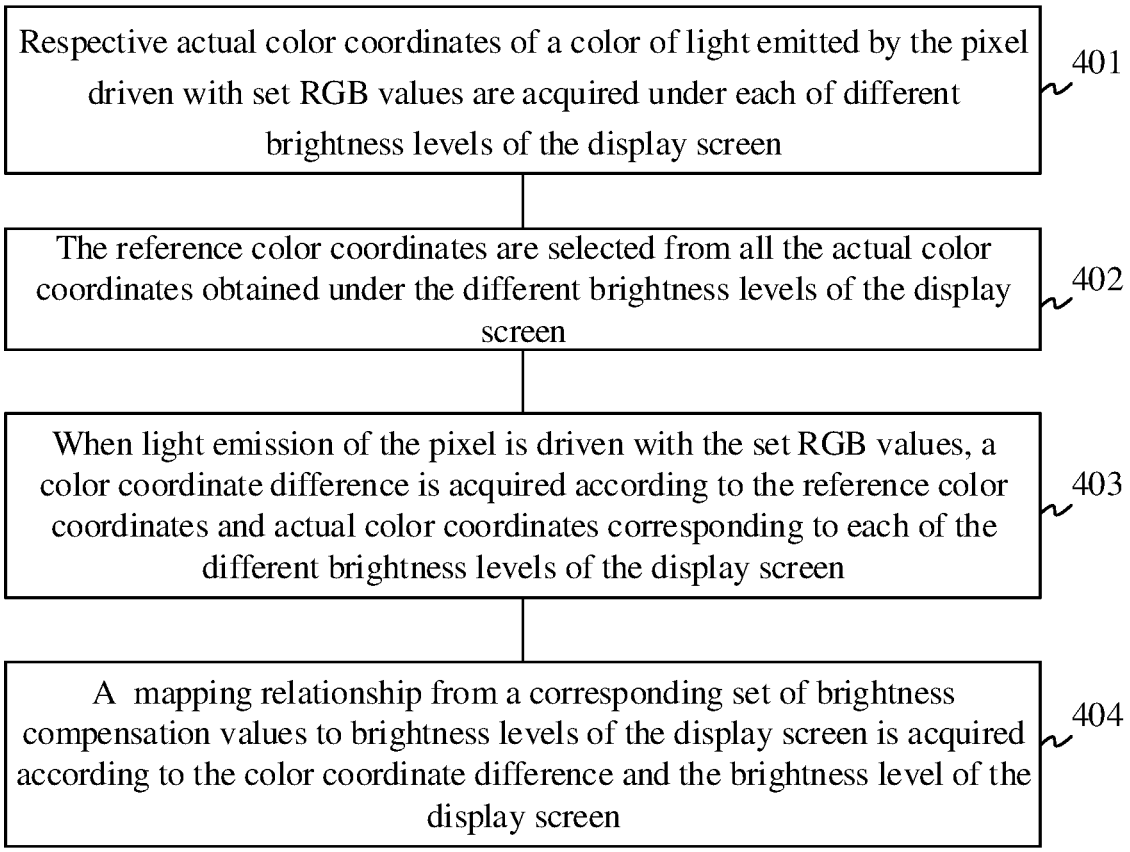
FIG. 4 illustrates a flowchart of a method for calibrating a color gamut of a display screen according to some embodiments of the present disclosure.

In some embodiments, the method for calibrating a color gamut of the display screen further includes that: the mapping relationship between brightness levels of the display screen and respective sets of brightness compensation values is acquired. FIG. 4 illustrates a flowchart of a method for calibrating a color gamut of a display screen according to some embodiments of the present disclosure. As illustrated in FIG. 4, the operation that the mapping relationship between the brightness level of the display screen and the brightness compensation values is acquired specifically includes the following blocks 410 to 404.

In block 401, respective actual color coordinates of a color of light emitted by the pixel driven with a set RGB values are acquired under each of different brightness levels of the display screen.

The set RGB values represent a color of light expected to be emitted by the pixel. The actual color coordinates represent an actual color of light emitted by the pixel, and may be obtained by directly using a detection device such as a spectrometer to measure the light emitted by the pixel. Exemplarily, when light emission of the pixel is driven with the same set RGB values, a dataset as illustrated in Table 1 is acquired in block 401.

TABLE 1

| Brightness level of display screen | Actual color coordinates |
|---|---|
| 1 | $X_1, Y_1, Z_1$ |
| 2 | $X_2, Y_2, Z_2$ |
| . . . | . . . |
| m | $X_m, Y_m, Z_m$ |

In Table 1, m is a positive integer smaller than or equal to a maximum brightness level that may be realized by the display screen. When different set RGB values are used as driving conditions for light emission of the pixel, a respective dataset as illustrated in Table 1 may be acquired for each of the set RGB values.

Moreover, in the dataset acquired for each of the set RGB values, the same brightness levels of the display screen are used. That is, colors of light emitted when the pixel is driven with different RGB values are acquired under the same brightness level of the display screen.

For example, when light emission of the pixel is driven with RGB values (255, 255, 0), actual color coordinates of light emitted by the pixel under brightness levels 0, 10, 20 and 30 of the display screen are acquired respectively. When light emission of the pixel is driven with RGB values (255, 0, 0), actual color coordinates of light emitted by the pixel under the brightness levels 0, 10, 20 and 30 of the display screen are acquired respectively.

In block 402, the reference color coordinates are selected from all the actual color coordinates obtained under the different brightness levels of the display screen.

The reference color coordinates serve a reference for acquiring the brightness compensation values. The brightness compensation values are used in purpose of compensating for the influence, on the accuracy of color gamut calibration, of a brightness change of the display screen and ensuring the accuracy of color gamut calibration under any brightness level of the display screen. Therefore, the actual color coordinates acquired under any brightness level of the display screen may be set as the reference color coordinates in block 402.

A set RGB values corresponds to a respective set of reference color coordinates. Moreover, after the reference color coordinates are set, a corresponding relationship between the set RGB values and the reference color coordinates is stored. Based on this, the reference color coordinates may be conveniently acquired according to the original RGB values in the subsequent step.

In block 403, when light emission of the pixel is driven with the set RGB values, a color coordinate difference is acquired according to the reference color coordinates and actual color coordinates corresponding to each of the different brightness levels of the display screen.

The color coordinate difference also includes x-axis, y-axis and z-axis coordinates. In the color coordinate difference, a numerical value in each dimension is a difference between a coordinate value of the reference color coordinates and a coordinate value of the actual color coordinates in the same dimension. For example, if the reference color coordinates are (x1, y1, z1) and the actual color coordinates are (x1', y1', z1'), the color coordinate difference is (x1−x1', y1−y1', z1−z1').

When light emission of the pixel is driven with the same RGB values, the color coordinate differences represent the influence, on the color of light emitted by the pixel, of the different brightness levels of the display screen. Specifically, as the coordinate value in any dimension (the x axis, the y axis or the z axis) in the color coordinate difference is greater, it is indicated that the influence, on the dimension (the x axis, the y axis or the z axis), of a brightness level change of the display screen is greater. Similarly, a set RGB values corresponds to a group of color coordinate differences.

In block 404, a mapping relationship from a corresponding set of brightness compensation values to brightness levels of the display screen is acquired according to the color coordinate difference and the brightness level of the display screen.

Since the color coordinate difference includes three dimensions, block 404 specifically includes that: the mapping relationship from the corresponding set of brightness compensation values to the brightness levels of the display screen is acquired in the three dimensions of the color coordinate difference.

For each dimension of the color coordinate difference, a group of color coordinate differences corresponding to each of different brightness levels of the display screen is acquired in block 403. In such case, multiple discretely distributed data points are formed in a coordinate system with the brightness level of the display screen as an abscissa axis and a coordinate value of the color coordinate difference as an ordinate axis. Curve fitting is performed on the discretely distributed data points, to obtain a corresponding relationship between a coordinate value in the dimension of a color coordinate difference and a brightness level of the display screen.

Figure 5:
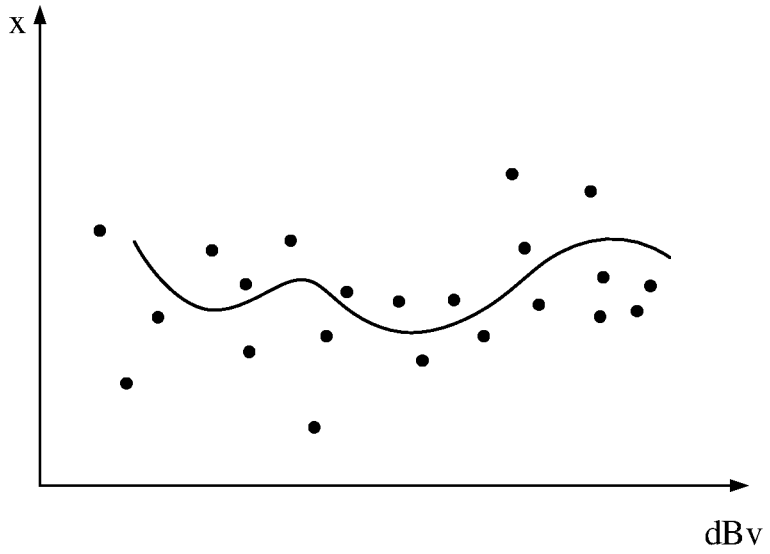
FIG. 5 illustrates a schematic diagram of a procedure of a method for calibrating a color gamut of a display screen according to some embodiments of the present disclosure.

FIG. 5 illustrates a schematic diagram of a procedure of a method for calibrating a color gamut of a display screen according to some embodiments of the present disclosure. Block 404 is described with a group of color coordinate differences corresponding to a set RGB values as an example.

As illustrated in FIG. 5, a first coordinate system is established by taking the brightness level (dBv) of the display screen as an abscissa axis and taking an x-axis numerical value of the color coordinate difference as an ordinate axis. Multiple discretely distributed data points are formed in the first coordinate system according to x-axis numerical values in the color coordinate differences acquired in block 403 and the brightness levels of the display screen corresponding to the color coordinate differences. Curve fitting is performed on the multiple discretely distributed data points to obtain a mapping relationship from brightness levels of the display screen to the x-axis numerical values of the color coordinate differences. That is, a mapping relationship $x=f_x(dBv)$ from brightness compensation values corresponding to the x axis to the brightness levels of the display screen is acquired.

Similarly, a second coordinate system is established by taking the brightness level (dBv) of the display screen as an abscissa axis and taking a y-axis numerical value of the color coordinate difference as an ordinate axis. Multiple discretely distributed data points are formed in the second coordinate system according to y-axis numerical values in the color coordinate differences acquired in block 403 and the brightness levels of the display screen corresponding to the color coordinate differences. Curve fitting is performed on the multiple discretely distributed data points to obtain a mapping relationship from the brightness levels of the display screen to the y-axis numerical values of the color coordinate differences. That is, a mapping relationship $y=f_y(dBv)$ from brightness compensation values corresponding to the y axis to the brightness levels of the display screen is acquired.

Similarly, a third coordinate system is established by taking the brightness level (dBv) of the display screen as an abscissa axis and taking a z-axis numerical value of the color coordinate difference as an ordinate axis. Multiple data points are formed in the third coordinate system according to z-axis numerical values in the color coordinate differences acquired in block 403 and the brightness levels of the display screen corresponding to the color coordinate differences. Curve fitting is performed on the multiple data points to obtain a mapping relationship from the brightness levels of the display screen to the z-axis numerical values of the color coordinate differences. That is, a mapping relationship $z=f_z$ (dBv) from brightness compensation values corresponding to the z axis to the brightness levels of the display screen is acquired.

In this way, the mapping relationship between the set of brightness compensation values and the brightness level of the display screen is acquired through block 404. The mapping relationship is configured to determine the set of brightness compensation values according to the brightness of the display screen and the original RGB values in block 1021.

It is to be noted that, in block 401 to block 404, a set RGB values corresponds to a group of mapping relationships. The set RGB values may be an RGB input value in an existing color gamut mapping method three-dimensional lookup table (3d LUT). In some embodiments, there are 9 reference points in each dimension of 3d LUT, and in such case, the 3d LUT includes 729 RGB input values. In some embodiments, there are 17 reference points in each dimension of 3dLUT, and in such case, 3dLUT includes 4913 RGB input values.

Moreover, the preset mapping relationship is substantially a corresponding relationship table of RGB values with respective corrected color coordinates, and the set RGB values may not be exhausted. Therefore, there may be the case that original RGB values of a pixel does not belong to the set RGB values in the mapping relationship. Under this condition, for such a pixel, the calibrated RGB values are determined by a 3d LUT interpolation operation after block 103.

Figure 6:
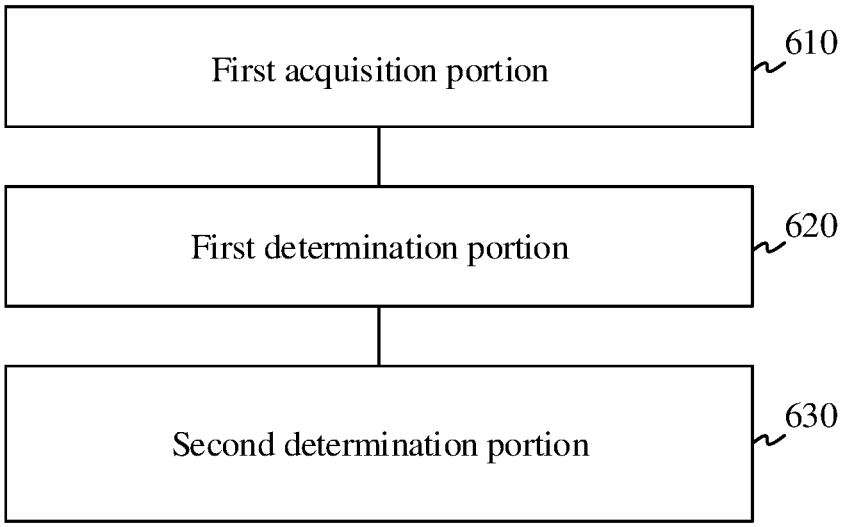
FIG. 6 illustrates a block diagram of a device for calibrating a color gamut of a display screen according to some embodiments of the present disclosure.

Based on the abovementioned method for calibrating a color gamut, a device for calibrating a color gamut is also provided in embodiments of the disclosure. FIG. 6 illustrates a block diagram of a device for calibrating a color gamut according to some embodiments of the present disclosure. As illustrated in FIG. 6, the device includes a first acquisition portion 610, a first determination portion 620 and a second determination portion 630.

The first acquisition portion 610 is configured to acquire a brightness level of a display screen, and original red green blue (RGB) values of a color to be displayed by a pixel in the display screen.

The first determination portion 620 is configured to determine, according to the brightness level of the display screen and the original RGB values, corrected color coordinates.

The second determination portion 630 is configured to determine a calibrated RGB values according to the corrected color coordinates, and driving, with the calibrated RGB values, light emission of the pixel in the display screen.

Figure 7:
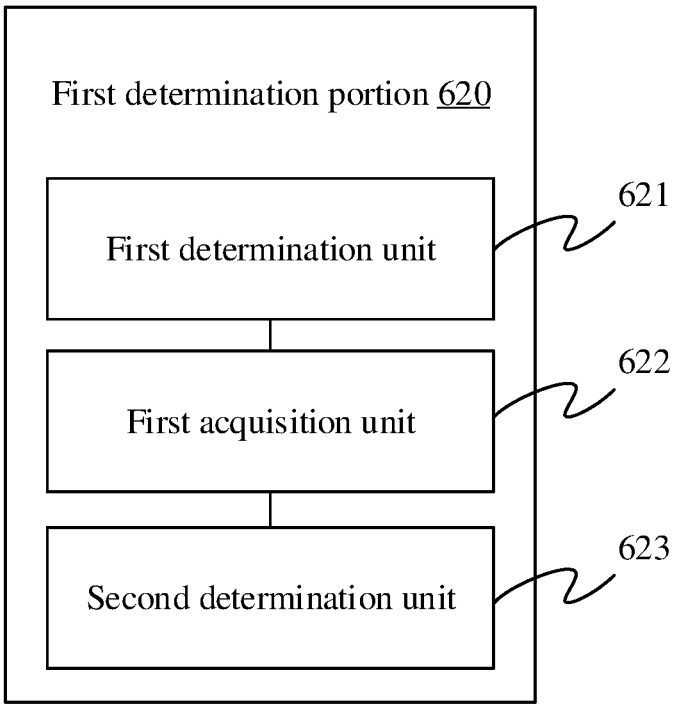
FIG. 7 illustrates a block diagram of the device for calibrating the color gamut of the display screen according to some embodiments of the present disclosure.

In some embodiments, FIG. 7 illustrates a block diagram of a device for calibrating a color gamut according to some embodiments of the present disclosure. As illustrated in FIG. 7, the first determination portion 620 includes a first determination unit 621, a first acquisition unit 622 and a second determination unit 623.

The first determination unit 621 is configured to determine, according to the brightness level of the display screen and the original RGB values, a set of brightness compensation values.

The first acquisition unit 622 is configured to acquire, according to the original RGB values, reference color coordinates corresponding to the RGB values.

The second determination unit 623 is configured to determine, according to the set of brightness compensation values and the reference color coordinates, the corrected color coordinates.

In some embodiments, the first determination unit 621 is specifically configured to determine, based on a preset mapping relationship, a brightness compensation value corresponding to each dimension of a color coordinate system according to the brightness level of the display screen and the original RGB values.

Figure 8:
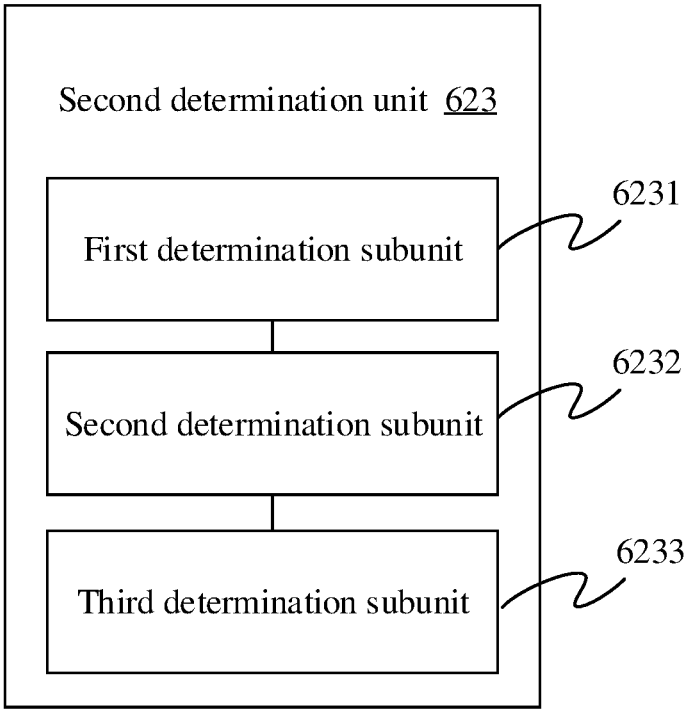
FIG. 8 illustrates a block diagram of the device for calibrating the color gamut of the display screen according to some embodiments of the present disclosure.

In some embodiments, FIG. 8 illustrates a block diagram of the device for calibrating the color gamut according to some embodiments of the present disclosure. The color coordinate system includes an x axis, a y axis, and a z axis. As illustrated in FIG. 8, the second determination portion 623 includes a first determination subunit 6231, a second determination subunit 6232 and a third determination subunit 6233.

The first determination subunit 6231 is configured to determine an x-axis coordinate of the corrected color coordinates, according to a brightness compensation value corresponding to the x axis and an x-axis coordinate of the reference color coordinates.

The second determination subunit 6232 is configured to determine a y-axis coordinate of the corrected color coordinates, according to a brightness compensation value corresponding to the y axis and a y-axis coordinate of the reference color coordinates.

The third determination subunit 6233 is configured to determine a z-axis coordinate of the corrected color coordinates, according to a brightness compensation value corresponding to the z axis and a z-axis coordinate of the reference color coordinates.

Figure 9:
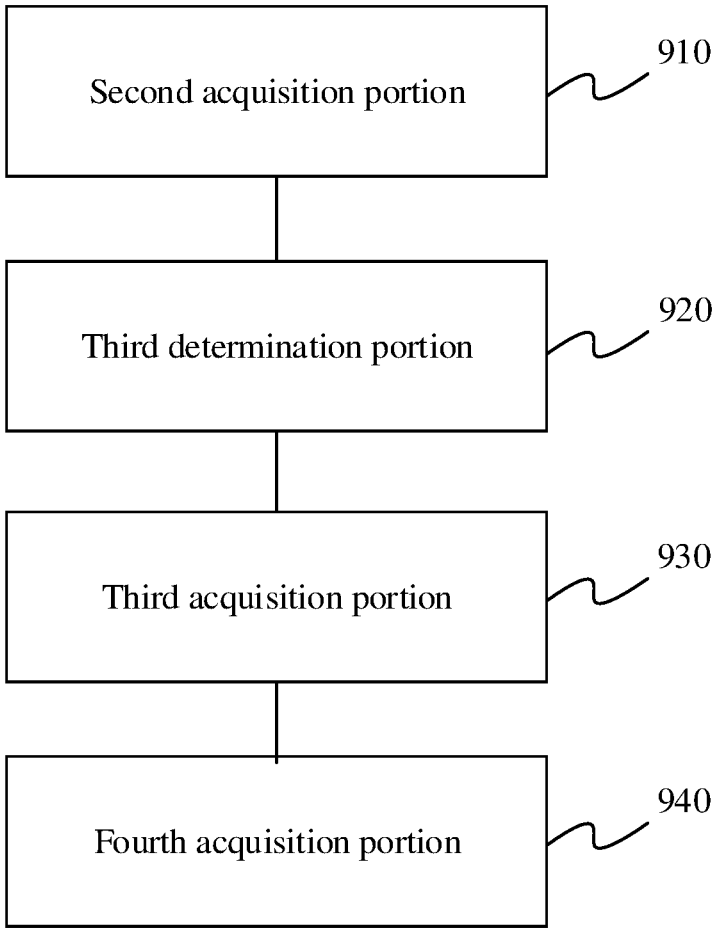
FIG. 9 illustrates a block diagram of the device for calibrating the color gamut of the display screen according to some embodiments of the present disclosure.

In some embodiments, FIG. 9 illustrates a block diagram of the device for calibrating the color gamut according to some embodiments of the present disclosure. As illustrated in FIG. 9, the device for calibrating the color gamut of the display screen further includes a second acquisition portion 910, a third determination portion 920, a third acquisition portion 930 and a fourth acquisition portion 940.

The second acquisition portion 910 is configured to acquire, under each of different brightness levels of the display screen, respective actual color coordinates of a color of light emitted by the pixel driven with set RGB values.

The third determination portion 920 is configured to select the reference color coordinates from all the actual color coordinates obtained under the different brightness levels of the display screen.

The third acquisition portion 930 is configured to: when light emission of the pixel is driven with the set RGB values, acquire a color coordinate difference according to the reference color coordinates and actual color coordinates corresponding to each of the different brightness levels of the display screen.

The fourth acquisition portion 940 is configured to acquire, according to the color coordinate difference and the corresponding brightness level of the display screen, a mapping relationship from a corresponding set of brightness compensation values to brightness levels of the display screen.

Figure 10:
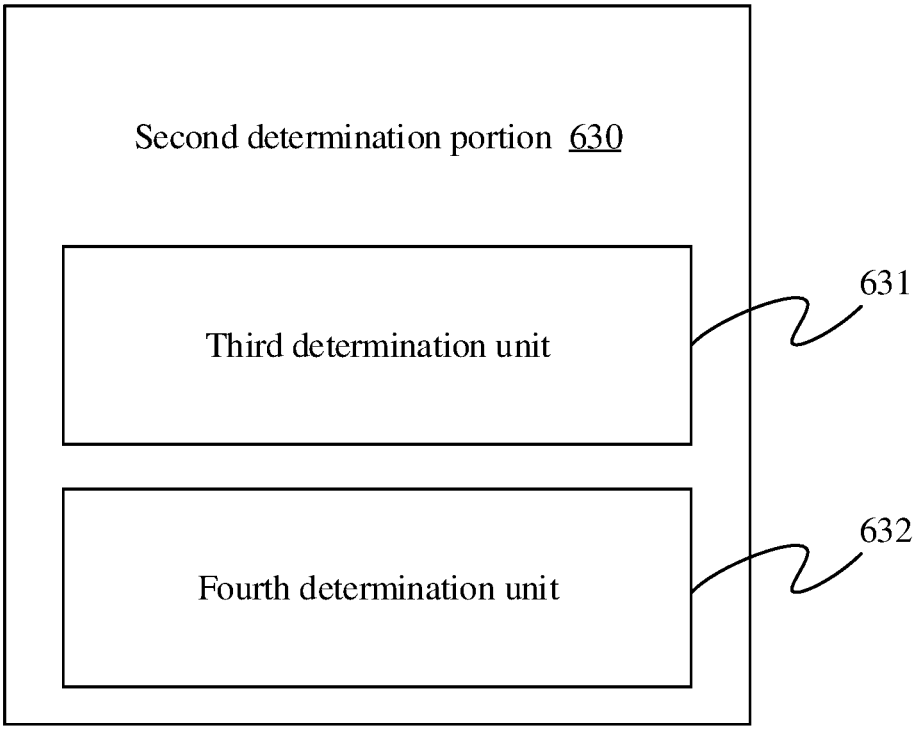
FIG. 10 illustrates a block diagram of the device for calibrating the color gamut of the display screen according to some embodiments of the present disclosure.

In some embodiments, FIG. 10 illustrates a block diagram of the device for calibrating the color gamut according to some embodiments of the present disclosure. As illustrated in FIG. 10, the second determination portion 630 includes a third determination unit 631 and a fourth determination unit 632.

The third determination unit 631 is configured to determine the calibrated color coordinates according to the corrected color coordinates.

The fourth determination unit 632 is configured to determine the calibrated RGB values according to the calibrated color coordinates.

In some embodiments, the third determination unit 631 is specifically configured to: convert, according to a rule of conversion from a source color gamut of the display screen to a target color gamut of the display screen, the corrected color coordinates into the calibrated color coordinates.

Figure 11:
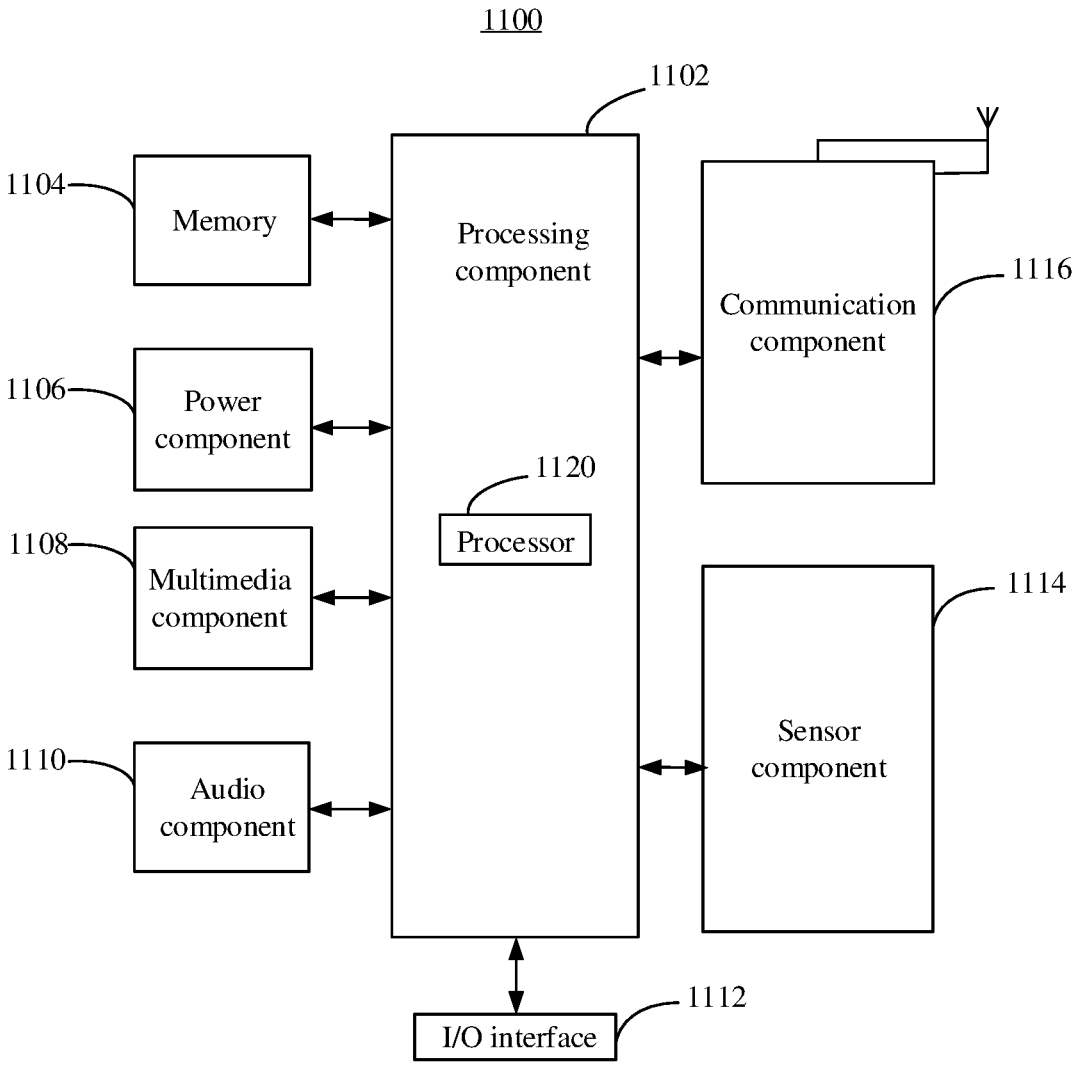
FIG. 11 illustrates a block diagram of an electronic device according to some embodiments of the present disclosure.

In addition, an electronic device is provided in embodiments of the disclosure. FIG. 11 illustrates a block diagram of an electronic device according to some embodiments of the present disclosure. As illustrated in FIG. 11, the electronic device 1100 may include one or more of the following components: a processing component 1102, a memory 1104, a power component 1106, a multimedia component 1108, an audio component 1110, an input/output (I/O) interface 1112, a sensor component 1114, a communication component 1116 and an image acquisition component.

The processing component 1102 typically controls overall operation of the electronic device 1100, such as operation associated with display, telephone calls, data communications, camera operations, and recording operations. The processing component 1102 may include one or more processors 1120 to execute instructions. Moreover, the processing component 1102 may include one or more modules which facilitate interaction of the processing component 1102 with the other components. For instance, the processing component 1102 may include a multimedia module to facilitate interaction of the multimedia component 1108 with the processing component 1102.

The memory 1104 is configured to store various types of data to support the operation of the electronic device 1100. Examples of such data include instructions for any application or methods operated on the electronic device 1100, contacts data, phonebook data, messages, pictures, video, etc. The memory 1104 may be implemented by any type of volatile or non-volatile memories, or a combination thereof, such as an Electrically Erasable Programmable Read-Only Memory (EEPROM), an Erasable Programmable Read-Only Memory (EPROM), a Programmable Read-Only Memory (PROM), a Read-Only Memory (ROM), a magnetic memory, a flash memory, and a magnetic or optical disk.

The power component 1106 provides power for various components of the electronic device 1100. The power component 1106 may include a power management system, one or more power supplies, and other components associated with generation, management and distribution of power for the electronic device 1100.

The multimedia component 1108 includes a display screen providing an output interface between the electronic device 1100 and a target object. In some embodiments, the display screen includes a display component and a touch panel. In this way, the display screen may be implemented as a touch screen to receive an input signal from the target object. The touch panel includes one or more touch sensors to sense touches, swipes and gestures on the touch panel. The touch sensors may not only sense a boundary of a touch or slide action but also detect a duration and pressure associated with the touch or slide action.

The audio component 1110 is configured to output and/or input an audio signal. For example, the audio component 1110 includes a Microphone (MIC), and the MIC is configured to receive an external audio signal when the electronic device 1100 is in the operation mode, such as a call mode, a recording mode and a voice recognition mode. The received audio signal may further be stored in the memory 1104 or sent through the communication component 1116. In some embodiments, the audio component 1110 further includes a speaker configured to output the audio signal.

The I/O interface 1112 provides an interface between the processing component 1102 and a peripheral interface module, and the peripheral interface module may be a keyboard, a click wheel, a button or the like.

The sensor component 1114 includes one or more sensors configured to provide status assessment in various aspects for the electronic device 1100. For instance, the sensor component 1114 may detect an on/off status of the electronic device 1100 and relative positioning of components, such as a display and keypad of the electronic device 1100, and the sensor component 1114 may further detect a change in a position of the electronic device 1100 or a component, presence or absence of contact between the target object and the electronic device 1100, orientation or acceleration/deceleration of the electronic device 1100 and a temperature change of the electronic device 1100. For another example, the sensor component 1114 further includes a light sensor, and the light sensor is arranged below the OLED display screen.

The communication component 1116 is configured to facilitate wired or wireless communication between the electronic device 1100 and another device. The electronic device 1100 may access a communication standard based wireless network, such as a Wireless Fidelity (Wi-Fi) network, a 2nd-Generation (2G), 3rd-Generation (3G), 4G, or 5G network or a combination thereof. In some embodiments of the present disclosure, the communication component 1116 receives a broadcast signal or broadcast associated information from an external broadcast management system through a broadcast channel. In some embodiments of the present disclosure, the communication component 1116 further includes a Near Field Communication (NFC) module to facilitate short-range communication. For example, the NFC module may be implemented based on a Radio Frequency Identification (RFID) technology, an Infrared Data Association (IrDA) technology, an Ultra-Wide Band (UWB) technology, a Bluetooth (BT) technology or another technology.

In some embodiments of the present disclosure, the electronic device 1100 may be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors or other electronic components.

Various embodiments of the methods and devices for calibrating a color gamut of a display screen, and the electronic devices provided in the disclosure can have one or more of the following advantages.

In the method for calibrating a color gamut of a display screen provided in some embodiments of the present disclosure, a brightness level of a display screen is used as a reference quantity for determining calibrated RGB values. In particular, corrected color coordinates are determined according to the brightness level of the display screen, and the calibrated RGB values is further determined according to the corrected color coordinates. By driving light emission of a pixel of the display screen using a calibrated RGB values, colors of light emitted by the pixel under different display brightness levels are unified. In this way, the hues of the colors of light emitted by the pixel always corresponds to the corrected color coordinates under different brightness levels of the display screen. In this way, the brightness of the display screen only affects the brightness of the color of light emitted by the pixel, and does not affect the hues of the light of color emitted by the pixel. Furthermore, accurate calibration of a color gamut is realized under different brightness levels of the display screen through the method.

In some embodiments of the present disclosure, a non-transitory computer-readable storage medium having executable instructions stored thereon is also provided in embodiments of the disclosure. The executable instructions may be executed by the processor of the electronic device to implement the steps of the abovementioned method for calibrating a color gamut of a display screen. The readable storage medium may be a ROM, a Random-Access Memory (RAM), a Compact Disc Read-Only Memory (CD-ROM), a magnetic tape, a floppy disc, an optical data storage device or the like.

The various device components, portions, units, blocks, or portions may have modular configurations, or are composed of discrete components, but nonetheless can be referred to as "portions" in general. In other words, the "components," "portions," "blocks," "portions," or "units" referred to herein may or may not be in modular forms.

In the present disclosure, the terms "installed," "connected," "coupled," "fixed" and the like shall be understood broadly, and can be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like can indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described can be combined in a suitable manner in any one or more embodiments or examples. In addition, various embodiments or examples described in the specification, as well as features of various embodiments or examples, can be combined and reorganized.

In some embodiments, the control and/or interface software or app can be provided in a form of a non-transitory computer-readable storage medium having instructions stored thereon is further provided. For example, the non-transitory computer-readable storage medium can be a ROM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, which is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium can be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment. A computer program can, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors or processing circuits suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), a CRT (cathode-ray tube), LCD (liquid-crystal display), OLED (organic light emitting diode), or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components.

The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features can be described above as acting in certain combinations and even initially claimed as such, one or more features from a claimed combination can in some cases be excised from the combination, and the claimed combination can be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing can be advantageous. Moreover, the separation of various system components in the implementations described above should not be understood as requiring such separation in all implementations, and it should be understood that the described program components and systems can generally be integrated together in a single software product or packaged into multiple software products.

As such, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing can be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It should be understood that "a plurality" or "multiple" as referred to herein means two or more. "And/or," describing the association relationship of the associated objects, indicates that there may be three relationships, for example, A and/or B may indicate that there are three cases where A exists separately, A and B exist at the same time, and B exists separately. The character "I" generally indicates that the contextual objects are in an "or" relationship.

In the present disclosure, it is to be understood that the terms "lower," "upper," "under" or "beneath" or "underneath," "above," "front," "back," "left," "right," "top," "bottom," "inner," "outer," "horizontal," "vertical," and other orientation or positional relationships are based on example orientations illustrated in the drawings, and are merely for the convenience of the description of some embodiments, rather than indicating or implying the device or component being constructed and operated in a particular orientation. Therefore, these terms are not to be construed as limiting the scope of the present disclosure.

Moreover, the terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, a first element being "on" a second element may indicate direct contact between the first and second elements, without contact, or indirect geometrical relationship through one or more intermediate media or layers, unless otherwise explicitly stated and defined. Similarly, a first element being "under," "underneath" or "beneath" a second element may indicate direct contact between the first and second elements, without contact, or indirect geometrical relationship through one or more intermediate media or layers, unless otherwise explicitly stated and defined.

Some other embodiments of the present disclosure can be available to those skilled in the art upon consideration of the specification and practice of the various embodiments disclosed herein. The present application is intended to cover any variations, uses, or adaptations of the present disclosure following general principles of the present disclosure and include the common general knowledge or conventional technical means in the art without departing from the present disclosure. The specification and examples can be shown as illustrative only, and the true scope and spirit of the disclosure are indicated by the following claims.

What is claimed is:

1. A method for calibrating a color gamut of a display screen, comprising:

acquiring a brightness level of the display screen, and original red green blue (RGB) values of a color to be displayed by a pixel in the display screen;

determining, according to the brightness level of the display screen and the original RGB values, corrected color coordinates; and determining a calibrated RGB values according to the corrected color coordinates, and driving, with the calibrated RGB values, light emission of the pixel in the display screen, wherein the determining, according to the brightness level of the display screen and the original RGB values, the corrected color coordinates comprises:

determining, according to the brightness level of the display screen and the original RGB values, a set of brightness compensation values;

acquiring, according to the original RGB values, reference color coordinates corresponding to the original RGB values; and determining, according to the set of brightness compensation values and the reference color coordinates, the corrected color coordinates.

2. The method according to claim 1, wherein the determining, according to the brightness level of the display screen and the original RGB values, the set of brightness compensation values comprises:

determining, based on a preset mapping relationship, a brightness compensation value corresponding to each dimension of a color coordinate system according to the brightness level of the display screen and the original RGB values.

3. The method according to claim 2, wherein the color coordinate system includes an x axis, a y axis, and a z axis, and the determining, according to the set of brightness compensation values and the reference color coordinates, the corrected color coordinates comprises:

determining an x-axis coordinate of the corrected color coordinates, according to a brightness compensation value corresponding to the x axis and an x-axis coordinate of the reference color coordinates;

determining a y-axis coordinate of the corrected color coordinates, according to a brightness compensation value corresponding to the y axis and a y-axis coordinate of the reference color coordinates; and determining a z-axis coordinate of the corrected color coordinates, according to a brightness compensation value corresponding to the z axis and a z-axis coordinate of the reference color coordinates.

4. The method according to claim 3, further comprising:

acquiring, under each of different brightness levels of the display screen, respective actual color coordinates of a color of light emitted by the pixel driven with set RGB values;

selecting the reference color coordinates from all the actual color coordinates obtained under the different brightness levels of the display screen;

when light emission of the pixel is driven with the set RGB values, acquiring a color coordinate difference according to the reference color coordinates and actual color coordinates corresponding to each of the different brightness levels of the display screen; and acquiring, according to the color coordinate difference and the corresponding brightness level of the display screen, a mapping relationship from a corresponding set of brightness compensation values to brightness levels of the display screen.

5. The method according to claim 1, wherein the determining the calibrated RGB values according to the corrected color coordinates comprises:

determining the calibrated color coordinates according to the corrected color coordinates; and determining the calibrated RGB values according to the calibrated color coordinates.

6. The method according to claim 5, wherein the determining the calibrated color coordinates according to the corrected color coordinates comprises:

converting, according to a rule of conversion from a source color gamut of the display screen to a target color gamut of the display screen, the corrected color coordinates into the calibrated color coordinates.

7. An electronic device implementing the method of claim 1, comprising an organic light-emitting diode (OLED) display screen, wherein the electronic device is configured to:

determine the calibrated RGB values based on the brightness level of the OLED display screen as a reference quantity;

determine the corrected color coordinates according to the brightness level of the OLED display screen;

further determine the calibrated RGB values according to the corrected color coordinates;

drive light emission of a pixel of the OLED display screen using the calibrated RGB values, thereby unifying colors of light emitted by the pixel under different display brightness levels, such that hues of colors of light emitted by the pixel always corresponds to the corrected color coordinates under the different display brightness levels of the OLED display screen, the brightness of the OLED display screen only affects the brightness of the colors of the light emitted by the pixel, and does not affect the hues of the colors of the light emitted by the pixel, realizing accurate calibration of the color gamut under different the brightness levels of the OLED display screen.

8. A device for calibrating a color gamut, comprising a processor; and memory for storing instructions executable by the processor; wherein the processor is configured to:

acquire a brightness level of a display screen, and original red green blue (RGB) values of a color to be displayed by a pixel in the display screen;

determine, according to the brightness level of the display screen and the original RGB values, corrected color coordinates; and determine a calibrated RGB values according to the corrected color coordinates, and driving, with the calibrated RGB values, light emission of the pixel in the display screen, wherein the processor is configured to:

determine, according to the brightness level of the display screen and the original RGB values, a set of brightness compensation values;

acquire, according to the original RGB values, reference color coordinates corresponding to the original RGB values; and determine, according to the set of brightness compensation values and the reference color coordinates, the corrected color coordinates.

9. The device of claim 8, wherein the processor is further configured to:

determine, based on a preset mapping relationship, a brightness compensation value corresponding to each dimension of a color coordinate system according to the brightness level of the display screen and the original RGB values.

10. The device of claim 9, wherein the color coordinate system includes an x axis, a y axis, and a z axis, and the processor is further configured to:

determine an x-axis coordinate of the corrected color coordinates, according to a brightness compensation value corresponding to the x axis and an x-axis coordinate of the reference color coordinates;

determine a y-axis coordinate of the corrected color coordinates, according to a brightness compensation value corresponding to the y axis and a y-axis coordinate of the reference color coordinates; and determine a z-axis coordinate of the corrected color coordinates, according to a brightness compensation value corresponding to the z axis and a z-axis coordinate of the reference color coordinates.

11. The device of claim 10, wherein the processor is further configured to:

acquire, under each of different brightness levels of the display screen, respective actual color coordinates of a color of light emitted by the pixel driven with set RGB values;

select the reference color coordinates from all the actual color coordinates obtained under the different brightness levels of the display screen;

when light emission of the pixel is driven with the set RGB values, acquire a color coordinate difference according to the reference color coordinates and actual color coordinates corresponding to each of the different brightness levels of the display screen; and acquire, according to the color coordinate difference and the corresponding brightness level of the display screen, a mapping relationship from a corresponding set of brightness compensation values to brightness levels of the display screen.

12. The device of claim 8, wherein the processor is configured to:

determine the calibrated color coordinates according to the corrected color coordinates; and determine the calibrated RGB values according to the calibrated color coordinates.

13. The device of claim 12, wherein the processor is configured to:

convert, according to a rule of conversion from a source color gamut of the display screen to a target color gamut of the display screen, the corrected color coordinates into the calibrated color coordinates.

14. A non-transitory computer-readable storage medium having executable instructions stored thereon, wherein the executable instructions, when executed by a processor, cause the processor:

acquire a brightness level of the display screen, and original red green blue (RGB) values of a color to be displayed by a pixel in the display screen;

determine, according to the brightness level of the display screen and the original RGB values, corrected color coordinates; and determine a calibrated RGB values according to the corrected color coordinates, and driving, with the calibrated RGB values, light emission of the pixel in the display screen, wherein the executable instructions further cause the processor to:

determine, according to the brightness level of the display screen and the original RGB values, a set of brightness compensation values;

acquire, according to the original RGB values, reference color coordinates corresponding to the original RGB values; and determine, according to the set of brightness compensation values and the reference color coordinates, the corrected color coordinates.

15. The non-transitory readable storage medium of claim 14, wherein the executable instructions further cause the processor to:

determine, based on a preset mapping relationship, a brightness compensation value corresponding to each dimension of a color coordinate system according to the brightness level of the display screen and the original RGB values.

16. The non-transitory readable storage medium of claim 15, wherein the color coordinate system includes an x axis, a y axis, and a z axis, and the executable instructions further cause the processor to:

determine an x-axis coordinate of the corrected color coordinates, according to a brightness compensation value corresponding to the x axis and an x-axis coordinate of the reference color coordinates;

determine a y-axis coordinate of the corrected color coordinates, according to a brightness compensation value corresponding to the y axis and a y-axis coordinate of the reference color coordinates; and determine a z-axis coordinate of the corrected color coordinates, according to a brightness compensation value corresponding to the z axis and a z-axis coordinate of the reference color coordinates.

17. The non-transitory readable storage medium of claim 16, wherein the executable instructions further cause the processor to:

acquire, under each of different brightness levels of the display screen, respective actual color coordinates of a color of light emitted by the pixel driven with set RGB values;

select the reference color coordinates from all the actual color coordinates obtained under the different brightness levels of the display screen;

when light emission of the pixel is driven with the set RGB values, acquiring a color coordinate difference according to the reference color coordinates and actual color coordinates corresponding to each of the different brightness levels of the display screen; and acquire, according to the color coordinate difference and the corresponding brightness level of the display screen, a mapping relationship from a corresponding set of brightness compensation values to brightness levels of the display screen.

* * * * *